US005802826A

United States Patent [19]

Sawhney et al.

[11] Patent Number: 5,802,826

[45] Date of Patent: Sep. 8, 1998

[54] PRODUCTION OF CORE/WRAP YARNS BY AIRJET AND FRICTION SPINNING IN TANDEM

[75] Inventors: A. Paul S. Sawhney, Metairie; Craig L. Folk, New Orleans; George F. Ruppenicker, Kenner, all of La.

[73] Assignee: The United States of America as represented by the Secretary of Agriculture, Washington, D.C.

[21] Appl. No.: 102,932

[22] Filed: Aug. 6, 1993

[51] Int. Cl.[6] ..... D02G 3/36

[52] U.S. Cl. ..... 57/5; 57/11; 57/12; 57/328; 57/335; 57/350; 57/401

[58] Field of Search ..... 57/5, 11, 12, 401, 57/335, 331, 350, 328

[56] References Cited

U.S. PATENT DOCUMENTS

| | | | |
|---|---|---|---|
| 4,130,983 | 12/1978 | Dammann et al. | 57/5 |
| 4,142,352 | 3/1979 | Nakahara | 57/328 |
| 4,168,601 | 9/1979 | Didek et al. | 57/58.95 |
| 4,183,202 | 1/1980 | Morihashi | 57/328 |
| 4,202,162 | 5/1980 | Vignon | 57/58.89 |
| 4,202,163 | 5/1980 | Turk et al. | 57/58.95 |
| 4,222,222 | 9/1980 | Didek et al. | 57/5 X |
| 4,241,574 | 12/1980 | Turk et al. | 57/5 X |
| 4,249,368 | 2/1981 | Fehrer | 57/6 X |
| 4,321,789 | 3/1982 | Dammann et al. | 57/5 X |
| 4,362,008 | 12/1982 | Parker et al. | 57/5 |
| 4,495,757 | 1/1985 | Dimitrov | 57/328 X |
| 4,680,924 | 7/1987 | Briner et al. | 57/401 X |
| 4,757,680 | 7/1988 | Berger et al. | 57/5 X |
| 4,860,530 | 8/1989 | Montgomery et al. | 57/6 X |

FOREIGN PATENT DOCUMENTS

| | | | |
|---|---|---|---|
| 2650309 | 2/1991 | France | 57/328 |
| 1061515 | 3/1989 | Japan | 57/328 |

*Primary Examiner*—William Stryjewski

*Attorney, Agent, or Firm*—M. Howard Silverstein; John D. Fado

[57] ABSTRACT

Core/wrap yarn is produced by continuously forming air jet-spun yarn and uninterruptedly continuously passing it to a friction spinner for purposes of wrapping the air jet-spun yarn with fibrous material in the friction spinner, so as to form core/wrap yarn.

20 Claims, 5 Drawing Sheets

PRODUCTION OF CORE/WRAP YARNS BY AIRJET AND FRICTION SPINNING IN TANDEM

FIELD OF INVENTION

The present invention relates to production of core/wrap yarns.

PRIOR ART

Prior art spinning systems for nonwrapped yarn include a number of dissimilar techniques such as ring spinning, 2-jet airjet spinning, air vortex systems, self twisting by axial oscillation rotor type open end, and electrostatic spinning. Prior art core/wrap yarn-producing systems also include a number of dissimilar techniques including ring spinning, hollow spindle, false-twist spinning, 2-jet airjet and several types of friction spinning.

When friction spinners are employed for producing core/wrap yarn in the prior art, the sheath or wrap material is fed to the spinner in the form of sliver, while the core material either may be in the form of sliver, continuous filament yarn or previously spun yarn.

Heretofore there has never been an attempt to combine dissimilar spinning techniques in a tandem, continuous fashion, for the purpose of producing core/wrap yarn. This inactivity perhaps is due to the diverse production speeds and problems associated with each technique. The lack of interest in combining dissimilar techniques also is due to structural and characteristic differences between different spinning systems, and the lack of technical knowhow of combining such systems.

The following definitions apply to several terms that appear in the specification and claims:

Carding—the use of a carding machine to align, clean, and straighten fibers, and to remove very short fibers as well as fine trash, to produce sliver.

Drawing—the making parallel and straightening of sliver fibers to improve the uniformity of linear density, usually accomplished in 1, 2 or 3 passages through drawing equipment known as draw frame or drafting frame. In each passage through a draw frame, several sliver strands are combined into a single sliver strand.

Drafting—the process whereby a fiber bundle such as sliver or roving is extended in length in order to reduce the linear density of the bundle and to increase parallelization of the fibers. Various forms of drafting are employed in carding, drawing, roving and spinning.

Sliver—the product produced by carding or drawing, i.e., a very coarse strand of fibers having essentially no twist.

Roving process—conversion of sliver by drafting into a thinner strand called a roving in which a small amount of twist (normally 1 turn per inch) is imparted to the strand. This step ordinarily is performed only in conjunction with subsequent ring spinning. No other type of spinning presently requires roving prior to spinning.

Ring spinning process—an operation for converting roving into yarn by drafting a roving and imparting a true, unidirectional twist through use of a ring and a moving traveler on a ring-spinning frame. A small percentage of ring-spinning machines do not require prior formation of roving, but instead convert sliver directly into yarn.

Airjet spinning is a system for converting fibrous sliver into a yarn, using compressed air (or vortex) to entangle fibers into a continuous yarn strand. See U.S. Pat. Nos. 4,183,202 and 4,142,354, and British patent no. 825,776 (1959).

Friction spinning is an operation in which a stream of fibers land on a core material between closely adjacent, perforated, hollow drums revolving in the direction of the nip therebetween. A vacuum is applied to the interior of the drums for the purpose of transporting or pulling in wrapping fibers to, and holding in, the nip. The core may or may not already be twisted when it enters the spinner. During friction spinning, a false twist is imparted to the core by the drums, in addition to whatever twist the core material possesses before entry into the system; but whatever twist is inserted by the drums essentially is taken out as the yarn exits from the system. See U.S. Pat. Nos. 4,130,983, 4,168,601, 4,202,162, 4,202,163, and British patent no. 2,094,843.

SUMMARY

A new core/wrap spinning system now has been developed in which two diverse spinning techniques are combined in a continuous, tandem-wise, uninterrupted manner.

Broadly, airjet-spun yarn first is formed on an airjet spinning system and then, in tandem, without interruption, as soon as it exits from the airjet-spinner, it immediately is wrapped, in a friction spinner, with cotton or other staple fibrous material fed to the system in the form of sliver.

Prior art friction spinning systems and the tandem system of the present invention both employ sliver as the starting material for the core, but the product produced by the present invention, in comparison to the prior art product, is much stronger, has a much softer fabric handle, is torque balanced, has no stripping problems during subsequent processing (e.g., weaving, knitting) has much improved core coverage, and can provide an English yarn count of 15 or greater (15–30) as well as a lower yarn count (1–14). Prior art friction spinning systems only are able to provide a yarn count up to 17.

In further comparison to using sliver as core feedstock, the core component of the present invention is a well-formed yarn structure with sufficient integrity, twist, strength, and surface characteristics (hairiness) which, being significantly different than those of the wrap component, enhance the strength, strip-resistance, cover-factor, and productivity of the composite yarn.

Another advantage is that core/wrap yarn of the present invention, in comparison to using sliver in the prior art as the core material in a friction spinner, is produced very rapidly because the core component is fairly well formed airjet spun yarn which is much stronger than the practically "twistless" core component sliver of prior art friction-spun composite yarns. Speeds as high as 450 meters per minute may be employed, in comparison to prior art production speeds of 250–300 meters per minute for pure friction spinners, and about 200 meters per minute for pure airjet spinners for similar yarn counts.

A further object is the elimination of roving, winding and material transportation processes.

Yet another object is to provide a system that requires much less floor space than otherwise would be required to wrap staple fibers around a yarn feedstock, because a completely separate spinning machine or process would be required to produce the feedstock yarn.

BRIEF DESCRIPTION OF DRAWINGS

Other objects and advantages will be obvious from the following more detailed description taken in conjunction with the drawings in which.

DETAILED DESCRIPTION

Figure 1:
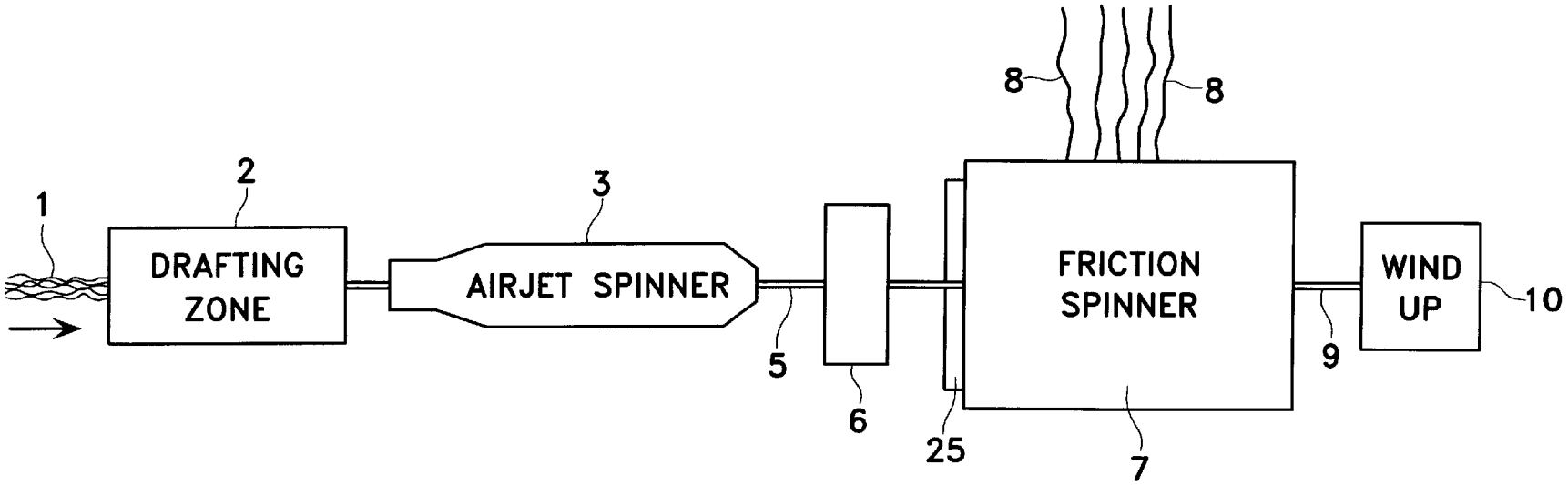
FIG. 1 is a schematic view of the tandem arrangement of the present invention.

Referring to FIG. 1, sliver 1 first is provided to a drafting zone 2 containing a series of conventional draft roller sets, afterwhich drafted sliver enters a conventional airjet spinner 3. As material exits from airjet spinner 3 in the form of S- or Z-twisted airjet-spun yarn 5, it first passes through a tension zone 6 whose function and details are described below, and then to friction spinner 7 wherein it is wrapped with sliver 8. Preferably, the twist direction of the airjet spinner is opposite to that of the friction spinner, in order to produce torqueless interlocking of core and sheath resulting in a soft (hand), torque-balanced, strong yarn with excellent strip-resistance and cover factor.

Tension zone 6 is located a few inches, e.g., about 1–2 inches, from the exit point of airjet spinner 3, so the zone will not block the discharge of exhaust air and debris (lint) exiting the air nozzle, thereby avoiding buildup of harmful back pressure, or retention of harmful debris, in the air nozzle. In addition, zone 6 is about ¾–1.0 inches from friction spinner 7.

As can be seen, the airjet-spun yarn as it forms is fed continuously and uninterruptedly into the friction spinner 7 (zone 6 does not interrupt flow). The time required to exit the airjet spinner and enter the friction spinner is less than 1/50 of a second. Wrapped product 9 immediately is conveyed to a conventional yarn wind-up zone 10.

During operation of the system, the twist direction generated in friction spinner 7 is transmitted upstream, i.e., backwards toward the airjet spinner. In order for the airjet spinner to function properly, it is important to prevent this backwardly-transmitted twist from migrating to the airjet spinner, whether the airjet spinner imparts a twist in the same or opposite direction as the backwardly-transmitted twist. The purpose of tension zone 6 is to impart enough tension to the yarn at this location so that the backwardly-transmitted twist is interrupted. In most instances, a tension of 6–7 grams placed on the yarn will be sufficient. This may be accomplished by increasing the frictional drag on the yarn, such as by passing it over a few rollers or bars.

Figure 2A:
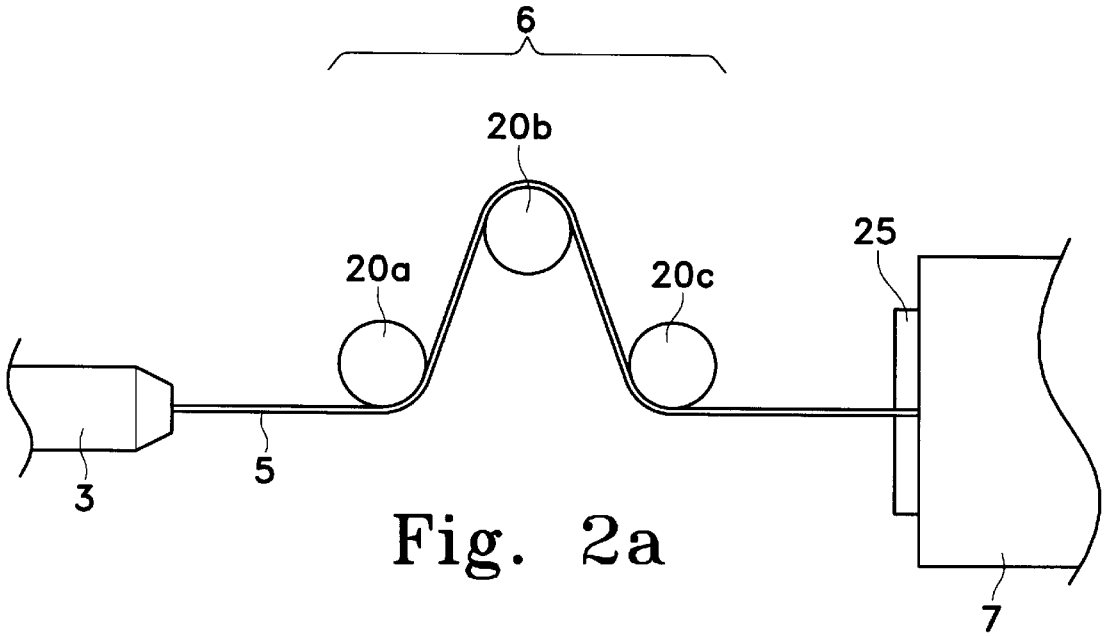
FIGS. 2*a–c* illustrate components of the device represented by reference numeral 6 in FIG. 1.

Alternative way to impart tension are illustrated in FIGS. 2*a–d*. In FIG. 2*a*, zone 6 is composed of a set of three frictionless (freely spinning) pulleys or rollers 20*a–c* (viewed at the ends thereof), preferably fabricated from steel. The pulleys/rollers are about ¾ inch in diameter. Yarn 5 passes under 20*a*, over 20*b* and under 20*c*.

Figure 2B:
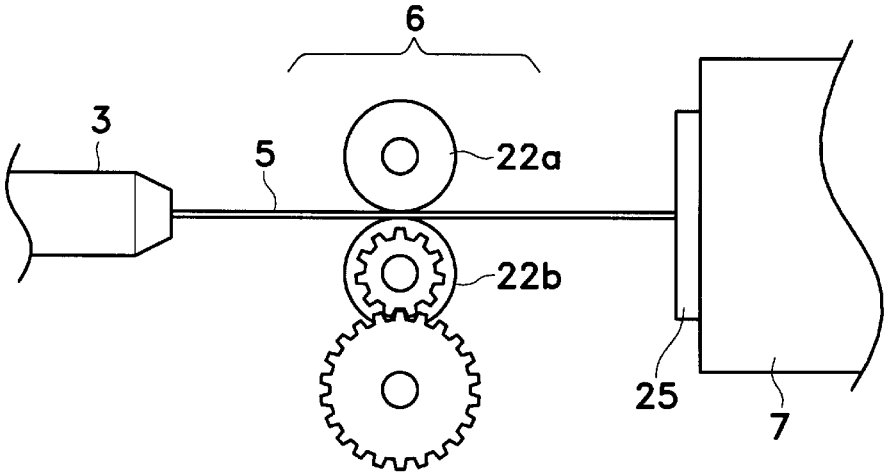

In the variation of FIG. 2*b*, the airjet-spun yarn passes between rollers 22*a* and *b*. Roller 22*a* has a covering such as synthetic rubber. Roller 22*b*, which may be steel, is poisitively driven in the direction of yarn movement at approximately the same speed as the yarn. The diameter of both rollers is about ¾ inch. To cause the requisite frictional drag and tension o-,n the yarn, the pressure exerted between the rollers is about 3 to 6 psi.

Figure 2C:
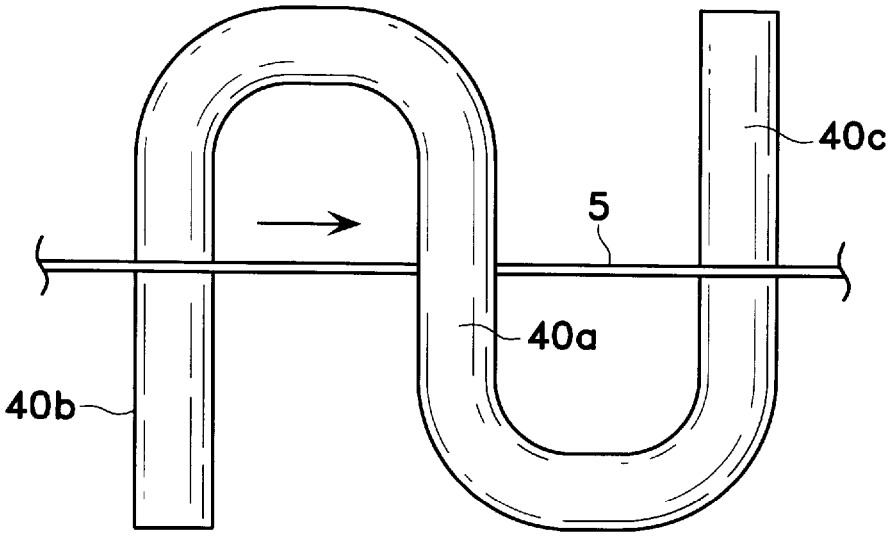
Figure 2D:
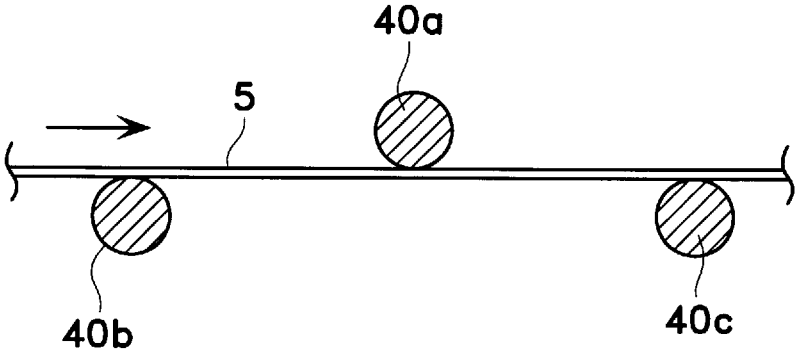

In the top view of the embodiment shown in FIG. 2*c*, the yarn is conveyed past an S-shaped bar (in cross-section the bar is circular, about ¼–⅜ inch diameter, as see in FIG. 2*d*), wherein the middle leg 40*a* of the "S" is in a plane slightly above the plane of the two legs, 40*b* and *c*, at the extremities of the "S". The yarn travels in a straight path across the legs, brushing first against the upper side of leg 40*a*, then against the underside of leg 40*b*, and finally against the upper side of leg 40*c*. The pressure of the legs against the yarn is about 3–5 psi, which causes the requisite frictional drag and tension the yarn. Preferably, the bar, usually metal, is coated with ceramic to prevent undesirable heat build-up.

Whatever means is employed to place tension upon the yarn, the frictional drag should not be so great as to cause excessive heat and possible rupture of a synthetic core yarn.

Figure 3A:
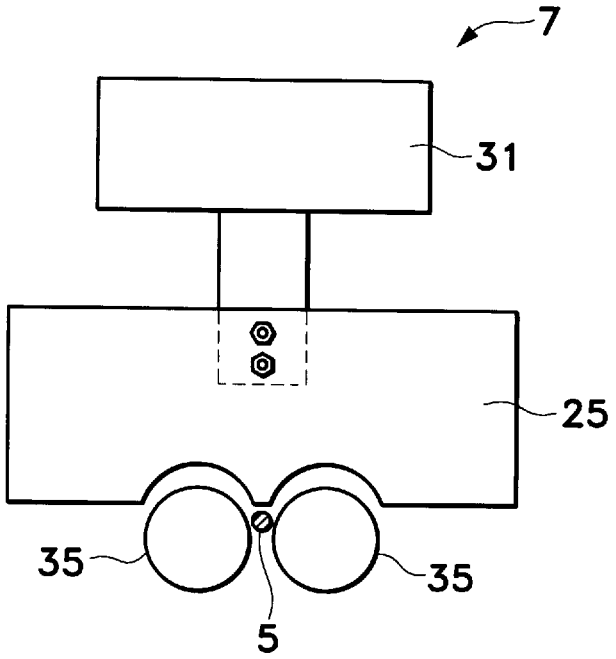
FIGS. 3*a*, 3*b* and 4 are views of the friction spinner at the yarn entrance.
Figure 3B:
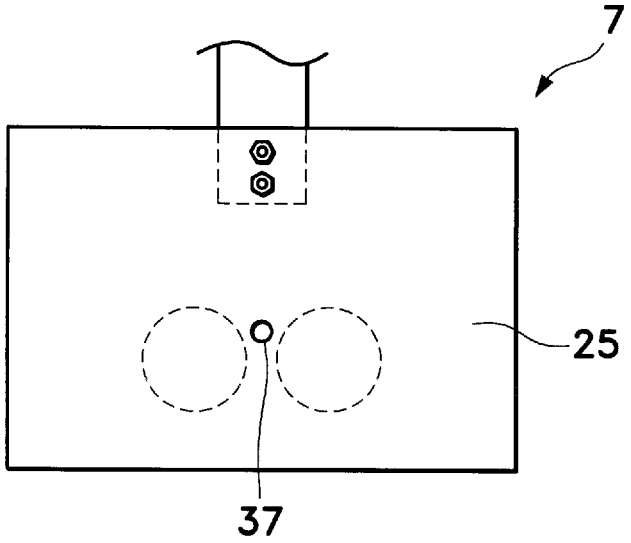

To prevent air interference between the air jet spinner and friction spinner, and to prevent contamination of the material in the friction spinning system by airborne debris or contaminants (.e.g., trash, short fibers) that exit from the airjet spinner, a barrier plate 25 (FIGS. 1, 3*a*, 3*b*) is connected to and held against the frame of friction spinner 7. The plate may be metal, about ¼ inch thick. It may be bolted to the shute 31 in friction spinner 7 that guides sliver to the friction drums 35 of the friction spinner, as shown in the yarn entrance view of the spinner in FIG. 3*a*. It may be sized to cover only the upper part of entrance to the friction drum pair in the friction spinner, as shown in said figure, so that yarn 5 passes immediately below the plate, or the plate may cover the entire entrance to friction drums 35, as shown in FIG. 3*b*, so that a small aperture eyelet 37, e.g., 0.1 to 0.2 inch diameter, must be provided in the plate for the passage of yarn 5.

Figure 4:
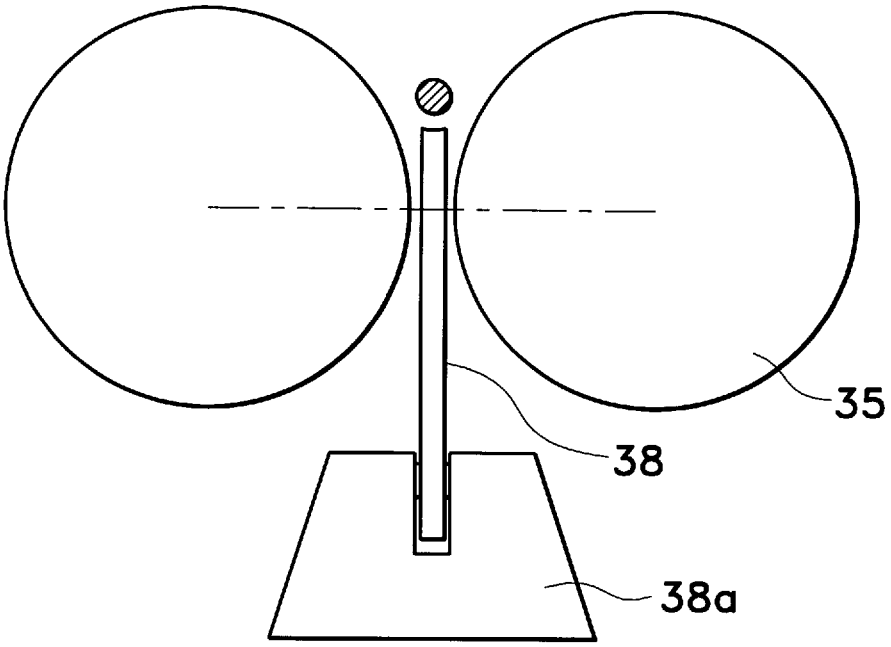

FIG. 4 is another yarn entrance view of the conventional perforated friction drums 35 in friction spinner 7. The drums typically are about 4–5 inches in length and 2–2.5 inches diameter. The narrowest part of the nip therebetween typically may be about 0.5 mm or less. There is a relative difference (about 5–6%) between rotational speeds of the drums, and, as a result, yarn, as it is wrapped, has a tendency to continuously alternate between being trapped between the nip of the drums, and then floating above the nip. As a result, prior art friction spun yarn product may tend to be too harsh and weak.

To reduce this harshness, the present invention optionally includes a modification to prior art friction spinners in the form of a thin blade 38 (FIG. 4) bolted to a base plate or bracket 38*a* that is attached to the frame of the friction spinner. The narrowest nip distance between the drums 35 is set at about 0.3 to 0.6 mm. The blade, typically 0.1 mm thinks is held in the nip and extends the full length thereof, e.g., 4–5 inches. The height of the blade may be about 2 ½ inches.

The top edge of the blade is slightly above, about 1 to 3 mm above, the imaginary enter line between the drum pair. The purpose of the blade is to prevent the yarn from entering the nip's narrowest point, or toy prevent undesirable fluctuation of the yarn that leads to its being trapped in the narrowest part of the nip. With the blade, the yarn barely floats and stabilizes above the upper edge of the blade thereby avoiding undesirable compressive pressure on the yarn caused by periodically being trapped in the nip. In other words, the upper edge of the blade provides a sort of platform for the yarn to rest upon and prevents the yarn from fluctuating between the narrowest part of the nip and the somewhat wider space immediately thereabove, and thereby prevents the yarn from periodically being trapped in the narrowest part of the nip, while still allowing the necessary yarn rolling action to accomplish wrapping of the covering fibers (e.g., cotton) onto the core. As a consequence, the yarn handle is improved (softened).

To accommodate different yarn counts or surface characteristics, the blade 38 can be raised or lowered in the groove or recess in blade support 38*a* (FIG. 4) which holds the blade, thereby raising or lowering the blade in the nip, but maintaining the blade's upper edge above the narrowest part of the nip.

Many fiber materials may be employed to produce the core or wrap including cotton, polyester, nylon, PBI, kevlar, rayon, fiberglass and similar fibers.

We claim:

1. Apparatus for producing core/wrap yarn comprising a friction spinner having two closely adjacent rotating drums, said spinner being downstream from an airjet spinner so that airjet-spun yarn, as it exits said airjet spinner, passes without interruption to said friction spinner to be wrapped with fibrous material in said friction spinner.

2. The apparatus of claim 1 further comprising means disposed between said airjet spinner and friction spinner to impart tension to said airjet spun yarn to inhibit backward flow and migration of core twist from said friction spinner to said airjet spinner.

3. The apparatus of claim 2 wherein said means to impart tension comprises a set of rollers disposed between said airjet spinner and friction spinner around which to said airjet-spun yarn passes prior to entry into said friction spinner.

4. The apparatus of claim 3 further comprising means disposed between said airjet spinner and friction spinner to prevent air interference therebetween and to prevent airborne debris exiting said airjet spinner from entering said friction spinner.

5. The apparatus of claim 2 wherein said means to impart tension comprises a pair of rollers disposed between said airjet and friction spinner between which said airjet-spun yarn passes prior to entry into said friction spinner.

6. The apparatus of claim 5 further comprising means disposed between said airjet spinner and friction spinner to prevent air interference therebetween and to prevent airborne debris exiting said airjet spinner from entering said friction spinner.

7. The apparatus of claim 2 wherein said means to impart tension comprises a plurality of bars over which said airjet-spun yarn transversely passes prior to entry into said friction spinner.

8. The apparatus of claim 7 further comprising means disposed between said airjet spinner and friction spinner to prevent air interference therebetween and to prevent airborne debris exiting said airjet spinner from entering said friction spinner.

9. The apparatus of claim 1 further comprising means disposed between said airjet spinner and friction spinner to prevent air interference therebetween and to prevent airborne debris exiting said airjet spinner from entering said friction spinner.

10. An apparatus for producing core/wrap yarn comprising a friction spinner having two closely adjacent rotating drums;

said spinner being downstream from an airjet spinner so that airjet-spun yarn, as it exits said airjet spinner passes without interruption to said friction spinner to be wrapped with fibrous material in said friction spinner;

wherein said friction spinner include a vertical blade disposed between said friction spinner's drums, said blade's top edge being about 1 to 3 above the narrowest point if the nip between said adjacent drums to prevent yarn from entering said nip's narrowest point.

11. An apparatus for producing core/wrap yarn comprising a friction spinner having two closely adjacent rotating drums;

said spinner being downstream from an airjet spinner so that airjet-spun yarn, as it exits said airjet spinner passes without interruption to said friction spinner to be wrapped with fibrous material in said friction spinner;

means disposed between said airjet spinner and friction spinner to impart tension to said airjet spun yarn to inhibit backward flow and migration of core twist from said friction spinner to said airjet spinner; wherein said means to impart tension comprises a set of rollers disposed between said airjet and friction spinner around which said airjet-spun yarn passes prior to entry into said friction spinner;

means disposed between said airjet spinner and friction spinner to prevent air interference therebetween and to prevent airborn debris exiting said airjet spinner from entering said friction spinner;

wherein said friction spinner includes a vertical blade disposed between said friction spinner's drums, said blade's top edge being about 1 to 3 mm above the narrowest point of the nip between said adjacent drums to prevent yarn from entering said nip's narrowest point.

12. An apparatus for producing core/wrap yarn comprising a friction spinner having two closely adjacent rotating drums;

said spinner being downstream from an airjet spinner so that airjet-spun yarn, as it exits said airjet spinner passes without interruption to said friction spinner to be wrapped with fibrous material in said friction spinner;

means disposed between said airjet spinner and friction spinner to impart tension to said airjet spun yarn to inhibit backward flow and migration of core twist from said friction spinner to said airjet spinner; wherein said means to impart tension comprises a pair of rollers disposed between said airjet and friction spinner between which said airjet-spun yarn passes prior to entry into said friction spinner;

means disposed between said airjet spinner and friction spinner to prevent air interference therebetween and to prevent airborn debris exiting said airjet spinner from entering said friction spinner;

wherein said friction spinner includes a blade disposed between said friction spinner's drums.

13. An apparatus for producing core/wrap yarn comprising a friction spinner having two closely adjacent rotating drums;

said spinner being downstream from an airjet spinner so that airjet-spun yarn, as it exits said airjet spinner passes without interruption to said friction spinner to be wrapped with fibrous material in said friction spinner;

means disposed between said airjet spinner and friction spinner to impart tension to said airjet spun yarn to inhibit backward flow and migration of core twist from said friction spinner to said airjet spinner; wherein said means to impart tension comprises a plurality of bars over which said airjet-spun yarn transversely passes prior to entry into said friction spinner;

means disposed between said airjet spinner and friction spinner to prevent air interference therebetween and to prevent airborn debris exiting said airjet spinner from entering said friction spinner;

wherein said friction spinner includes a vertical blade disposed between said friction spinner's drums.

14. A method for producing core/wrap yarn comprising forming yarn by airjet-spinning and passing said yarn as it forms to a friction spinner with adjacent rotating drums having a nip therebetween to wrap said yarn with fibrous material.

15. The method of claim 14 further comprising imparting sufficient tension to said airjet spun yarn to inhibit backward flow and migration of core twist from said friction spinner to said airjet spinner.

16. The method of claim 15 further comprising preventing air interference between said airjet-spinning and friction spinning, and preventing airborne debris caused by said airjet-spinning from passing to said friction spinning step.

17. The method of claim 16 further comprising preventing yarn from entering said nip's narrowest point.

18. The method of claim 14 further comprising preventing air interference between said airjet-spinning and friction spinning, and preventing airborne debris caused by said airjet-spinning from passing to said friction spinning step.

19. The method of claim 18 further comprising preventing yarn from entering said nip's narrowest point.

20. The method of claim 14 further comprising preventing yarn from entering said nip's narrowest point.

* * * * *